US010054908B2

(12) United States Patent
Di Domenico et al.

(10) Patent No.: US 10,054,908 B2
(45) Date of Patent: Aug. 21, 2018

(54) ESCAPEMENT WITH ESCAPE WHEEL WITH FIELD RAMPS AND NON-RETURN

(71) Applicant: The Swatch Group Research and Development Ltd, Marin (CH)

(72) Inventors: Gianni Di Domenico, Neuchatel (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 48 days.

(21) Appl. No.: 15/222,517

(22) Filed: Jul. 28, 2016

(65) Prior Publication Data

US 2017/0038737 A1 Feb. 9, 2017

(30) Foreign Application Priority Data

Aug. 4, 2015 (EP) ..... 15179709

(51) Int. Cl.
*G04C 3/04* (2006.01)
*G04C 3/06* (2006.01)
(Continued)

(52) U.S. Cl.
CPC ..... *G04C 5/005* (2013.01); *G04B 11/026* (2013.01); *G04C 3/04* (2013.01); *G04C 3/06* (2013.01);
(Continued)

(58) Field of Classification Search
CPC . G04C 3/04; G04C 3/06; G04C 3/066; G04C 3/067; G04C 5/00; G04C 5/005
See application file for complete search history.

(56) References Cited

U.S. PATENT DOCUMENTS 101,398 A 3/1870 Woerd
2,068,788 A * 1/1937 Baumann ..... B41J 19/38 400/331.3
(Continued)

FOREIGN PATENT DOCUMENTS

BE 680 716 10/1966
CH 17033 3/1899
(Continued)

OTHER PUBLICATIONS

International Search Report dated Jan. 26, 2016 in 15179709.9 filed on Aug. 4, 2015 (with English Translation of Categories of Cited Documents).

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A timepiece escapement mechanism including a resonator and an escape wheel arranged to cooperate with this resonator directly or indirectly through a stopper forming part of this escapement mechanism, this escape wheel including a succession of tracks carrying magnetic or electrostatic field potential ramps arranged to cooperate with the resonator or respectively with the stopper, this escapement mechanism comprising a non-return device arranged to oppose the recoil of the escape wheel, and the stopper cooperates, on the one hand, with a plate forming part of the resonator and, on the other, with these magnetic or electrostatic field potential ramps by at least one pole shoe forming part of the stopper and arranged to move in the field corresponding to the magnetic or electrostatic field potential ramps.

14 Claims, 6 Drawing Sheets

(51) Int. Cl.
*G04C 5/00* (2006.01)
*G04B 11/02* (2006.01)

(52) U.S. Cl.
CPC ..... *G04C 3/066* (2013.01); *G04C 3/067* (2013.01); *G04C 5/00* (2013.01)

(56) References Cited

U.S. PATENT DOCUMENTS

| | | | | | |
|---|---|---|---|---|---|
| 3,451,280 | A | | 6/1969 | Hetzel | |
| 3,540,206 | A | | 11/1970 | Hetzel | |
| 3,609,958 | A | * | 10/1971 | Bertsch | G04C 5/005 310/37 |
| 3,670,493 | A | * | 6/1972 | Wuthrich | G04B 11/04 368/129 |
| 3,685,279 | A | * | 8/1972 | Scholz | G04B 15/12 368/128 |
| 5,779,171 | A | * | 7/1998 | Milano, Jr. | A01K 89/0117 192/48.6 |
| 2008/0150391 | A1 | | 6/2008 | Le Moal et al. | |
| 2015/0177690 | A1 | | 6/2015 | Di Domenico et al. | |

FOREIGN PATENT DOCUMENTS

| | | | |
|---|---|---|---|
| EP | 2 887 157 | A1 | 6/2015 |
| EP | 2 889 704 | A2 | 7/2015 |
| EP | 2 911 014 | A2 | 8/2015 |
| EP | 2 911 015 | A2 | 8/2015 |
| FR | 1 258 417 | | 4/1961 |
| FR | 2 883 276 | | 9/2006 |

* cited by examiner

ESCAPEMENT WITH ESCAPE WHEEL WITH FIELD RAMPS AND NON-RETURN

This application claims priority from European Patent Application No. 15179709.9 filed on Aug. 4, 2015, the entire disclosure of which is hereby incorporated herein by reference.

FIELD OF THE INVENTION

The invention relates to a timepiece escapement mechanism comprising at least one resonator and at least one escape wheel arranged to cooperate with a said resonator mechanism either directly or indirectly through a stopper forming part of said escapement mechanism, wherein said escape wheel comprises a succession of tracks carrying magnetic or electrostatic field potential ramps and said ramps are arranged to cooperate with said resonator or respectively with said stopper, wherein said escapement mechanism comprises at least one non-return device arranged to oppose the return of said escape wheel, and said stopper cooperates, on the one hand, with a plate forming part of said resonator mechanism and, on the other, with magnetic or electrostatic field potential ramps by at least one pole shoe forming part of said stopper and arranged to move in the field corresponding to said magnetic or electrostatic field potential ramps.

The invention also relates to a timepiece movement comprising at least one such escapement mechanism.

The invention also relates to a watch comprising at least one such escapement mechanism.

The invention relates to the field of escapement mechanisms in mechanical horology, and more particularly to the field of controlled field escapements, so-called magnetic escapements, or electrostatic escapements of the like.

BACKGROUND OF THE INVENTION

Document EP 2887157 in the name of SWATCH GROUP RESEARCH & DEVELOPMENT Ltd describes an optimised timepiece escapement with a stopper cooperating, on the one hand, with a balance plate and, on the other hand, with magnetic or electrostatic field barriers arranged on tracks of the escape wheel. Such a device improves the efficiency of the escapement quite significantly because of reduced or non-existent contacts. However, its development is above all effective when operation is not too abrupt. In fact, it concerns reducing the bounces of the escape wheel, which if not controlled can lead to an unstable situation. In a traditional, entirely mechanical, Swiss anchor escapement the escape wheel supplies a certain amount of energy from a barrel or other similar accumulator to the spring balance. The excess kinetic energy of the escape wheel is dissipated when one of its teeth drops onto the resting plane of the pallet stone of the anchor during the fall. This very severe shock effectively prevents the escape wheel from bouncing.

In an escapement with magnetic or electrostatic field barriers, such as those described in patent applications EP 2887157 cited above, EP 14186297, EP 14186296 and EP 14186261 of the same applicant, all incorporated herein by reference, the interaction between a pole shoe of the escape wheel (the "tooth") and a pole shoe of the anchor (the "pallet stone") is conservative: the kinetic energy of the wheel is no longer dissipated by the shock of the fall, it is almost fully restored to the wheel in the opposite direction. Bounces are thus observed. FIG. 1 illustrates in principle: the escape wheel, pushed by the barrel, partially moves up the magnetic (or electrostatic, as appropriate) potential barrier; when the torque of the barrier dominates that supplied by the barrel, the wheel stops, then goes back in the other direction. The wheel thus oscillates around a stable tipping position that is always the same. The friction due to the pivots as well as the aerodynamic losses lead to damp the wheel after numerous oscillations.

Bounces are necessary for an operation at constant force since they allow excess energy to dissipate. Nevertheless, it is important to control their duration, which must be less than a half-cycle so that the system functions stably. On the other hand, it is worthwhile to completely prevent bounces in order to store the excess energy in the magnetic (or electrostatic, as appropriate) potential to enable this energy to be recycled, and this then results in a significant increase in the efficiency of the escapement.

Document EP 2889704 A2 in the name of NIVAROX-FAR SA describes a timepiece escapement mechanism comprising an escape wheel subjected to a pivoting torque of a moment lower than or equal to a nominal moment around a first pivot axis, and a resonator fixed to a regulator wheel set mounted to pivot around a real or virtual second pivot axis. This escape wheel comprises a plurality of actuators evenly spaced over its periphery, each arranged to cooperate directly with at least a first track of the regulator wheel set. Each actuator comprises first magnetic or electrostatic stop means forming a barrier and arranged to cooperate with the first track, which is magnetised, respectively electrified, or ferromagnetic, or respectively electrostatically conductive, to exert a torque of higher moment than the nominal moment on the first track. Each actuator also comprises second stop means arranged to form a path limit stop arranged to form an autonomous escapement mechanism with at least one first complementary stop surface forming part of the regulator wheel set.

Document BE 680716 in the name of Centre Technique Horloger SA describes an electromechanical watch comprising a device for transforming the oscillating movement of a resonator with a frequency higher than 300 Hz into a continuous and vibrationless rotation movement comprising a pawl fixed to the resonator driving a ratchet wheel. The latter is fixed to a coaxial pole wheel with a moment of inertia lower than that of the ratchet wheel and magnetically driving another wheel in such a manner that the influence on the ratchet wheel of the inertia of the driven wheel is practically negligible.

SUMMARY OF THE INVENTION

The objective of a non-return device such as a pawl or similar in an escapement device with a stopper cooperating with a balance plate and with magnetic or electrostatic field barriers, in particular in the form of a magnetic anchor, is to prevent the escape wheel from bouncing on the magnetic barriers, or electrostatic barriers as appropriate.

The invention proposes to stop the bounces of such a magnetic or electrostatic escapement device by adding a non-return device, which the energy of the escape wheel to be stored temporarily in the magnetic or electrostatic potential so that it can be restored to the balance or similar during the escapement function, which causes a significant increase in the efficiency of this type of escapement, in particular when the torque supplied by the barrel or the accumulator is high.

More particularly, the invention endeavours to increase the energy efficiency of the escapement mechanism and of the movement.

For this, the invention relates to a timepiece escapement mechanism.

The invention also relates to a timepiece movement comprising at least one such escapement mechanism.

The invention also relates to a watch comprising at least one such escapement mechanism.

BRIEF DESCRIPTION OF THE DRAWINGS

Other features and advantages of the invention will become clear on reading the following detailed description with reference to the attached drawings.

DETAILED DESCRIPTION OF PREFERRED EMBODIMENTS

Figure 1:
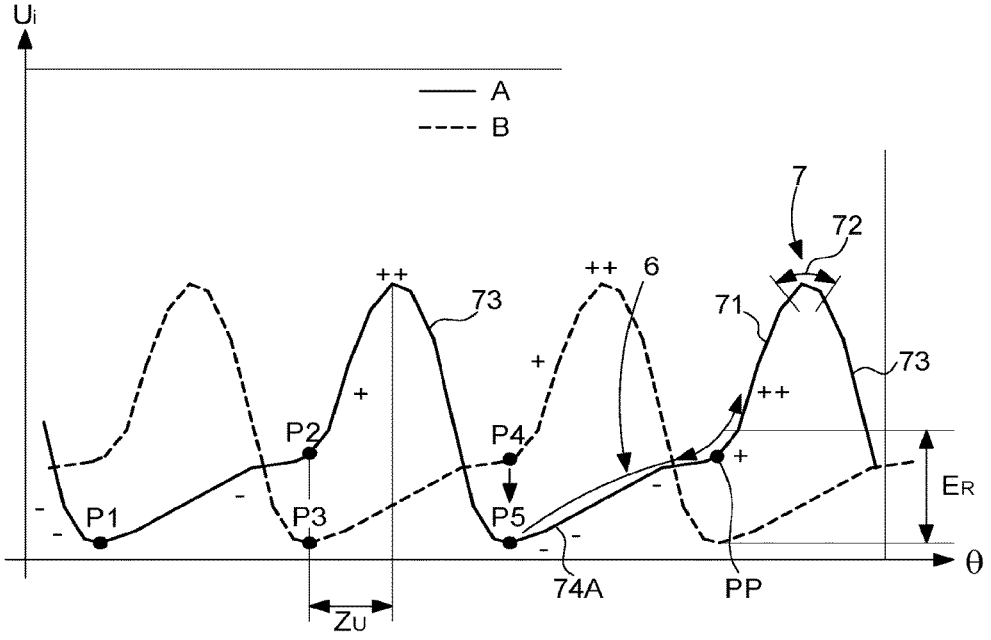
FIG. 1 schematically shows a diagram for a magnetic escapement mechanism illustrating the variation in potential energy as ordinate as a function of the angle at the centre as abscissa.

The invention proposes a simple and reliable solution to control the bounces of a magnetic or electrostatic escapement device by adding a non-return device, which allows the efficiency of this type of escapement to be increased, in particular when the torque supplied by the barrel or the accumulator is high. This non-return mechanism allows the energy of the barrel or similar to be a cumulated to restore it in the resonator.

The invention relates to a timepiece escapement mechanism 200 comprising at least one resonator 100. The escapement mechanism 200 comprises at least one escapement wheel set. This wheel set is described and illustrated here in the particular and non-restricting case of an escape wheel 1, but can take other forms such as a cylinder or other. In this non-restrictive variant the escapement mechanism 200 comprises at least one escape wheel 1, which is arranged to cooperate with such a resonator mechanism 100 either directly or indirectly through a stopper 2, which forms part of this escapement mechanism 200.

The invention is illustrated in a non-restrictive manner with an escapement with a stopper, wherein in a particular, and again non-restrictive, example this stopper 2 is formed by a pivoting anchor comprising, as appropriate, a single pole shoe 3 arranged to cooperate alternately with tracks of the escape wheel comprising magnetic or electrostatic fields of variable intensity, or also two pole shoes 3 arranged to cooperate alternately with at least one track 4 of the escape wheel 1 comprising magnetic or electrostatic fields of variable intensity.

The invention also applies to other types of escapement mechanisms, cylinder, natural or other mechanisms in the case of direct cooperation without stopper.

The escape wheel 1 comprises a succession of tracks 4, or also 40, 41, 42 according to variants described below. These tracks 4 are carriers of ramps 6 of increasing magnetic or electrostatic field potential. These ramps 6 are arranged to cooperate with the resonator 100 or respectively with the stopper 2.

According to the invention this escapement mechanism 200 comprises at least one non-return device 5, which is arranged to oppose the return of the escape wheel 1, i.e. to prevent it from recoiling in relation to its normal pivoting direction.

More particularly, the escapement mechanism 200 comprises a stopper 2 cooperating, on the one hand, with a plate that forms part of the resonator mechanism 100, in particular a balance plate in the case of a spring-balance resonator, and cooperating on the other hand with magnetic or electrostatic field potential ramps 6 by at least one pole shoe 3, or also 30, 31, 32 according to the variants described below, forming part of this stopper 2. This pole shoe 3 is arranged to move in the field corresponding to these magnetic or electrostatic field potential ramps 6.

Figure 10:
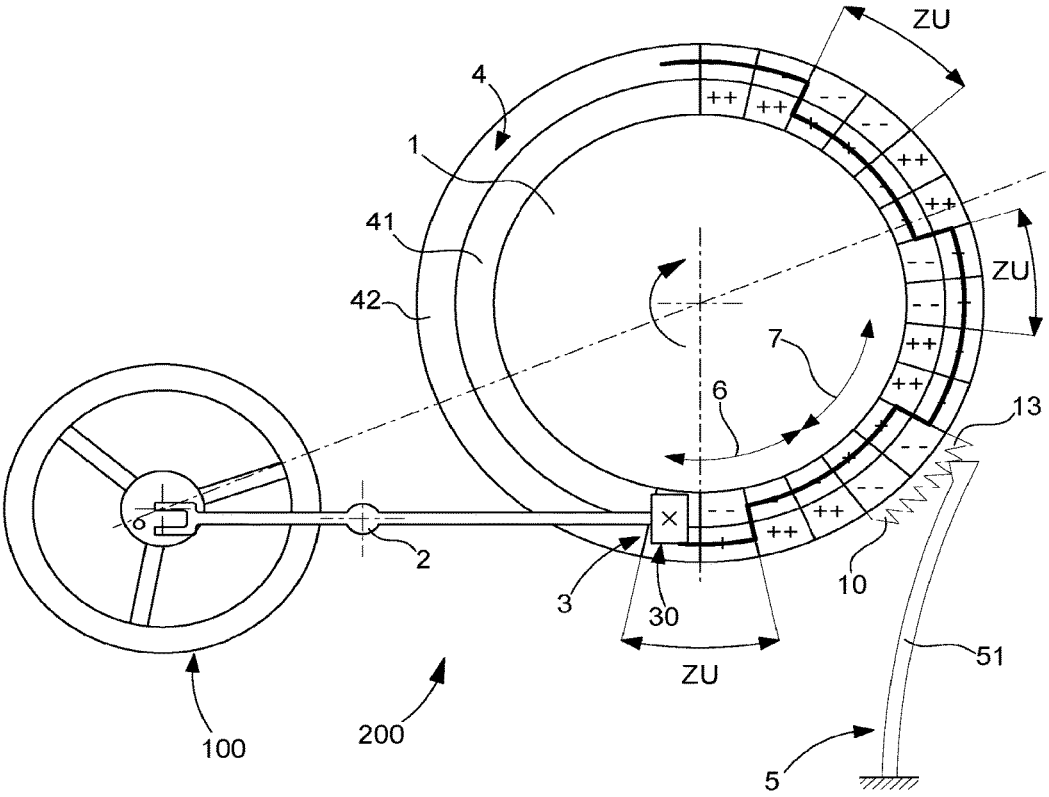
FIG. 10 illustrates in a plan view an escape wheel comprising two concentric tracks with alternate ramps extended by potential barriers and an anchor-type stopper with a single pole shoe mounted to pivot in order to cooperate alternately with these two tracks.

FIG. 1 takes the instruction of patent application EP 28871573 relating to a magnetic escapement device 200 with a stopper 2 with a single pole shoe 30 pivoting in order to cooperate alternately with an inside track and an outside track, as shown in FIG. 10. This diagram illustrates the variation in potential energy as ordinate along magnetised tracks as a function of the angle at the centre as abscissa for each of the two tracks of FIG. 1: inside track as a solid line and outside track as a broken line, each comprising a succession of magnetised zones with different intensities and exerting different repelling forces in interaction with the pole shoe of the anchor when the latter is in their immediate vicinity, wherein the immediately adjacent zones of the two adjacent concentric tracks also have a different level of magnetisation.

This FIG. 1 shows the potential energy accumulation taken from the escape wheel 1 on sections P1-P2 and P3-P4 each corresponding to a half cycle, and its restoration by the anchor 2 to the balance during the change of track of the pole shoe P2-P3 and P4-P5. This FIG. 1 shows a particular position PP at the level of a significant change in slope between a ramp 6 and a potential barrier 7, which extends it, around which position PP the bounces are absorbed because of the potential slopes of the fields. The value ER designates the energy of the ramp 6 in this point, i.e. the difference between the energy level of this particular point PP and the minimum potential level of the tracks 4 of the escape wheel 1.

The invention is described and illustrated here in the magnetic alternative with a non-return device on the escape wheel. A person skilled in the art will know how to configure electrostatic and mixed alternatives by referring to the above-cited patent applications of the same applicant.

Figure 2:
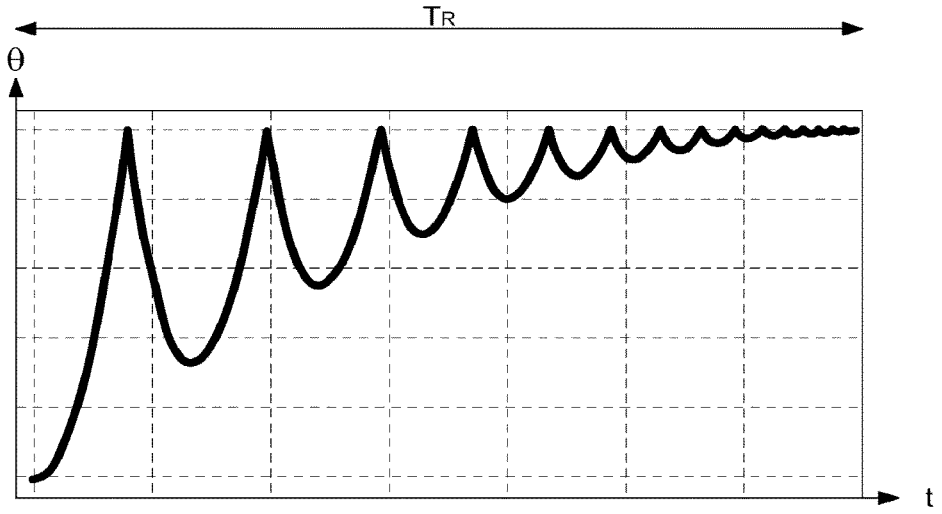
FIG. 2 schematically shows a simulation of the development of the bounces of the escape wheel with the angle of rotation of the wheel as ordinate as a function of time as abscissa.

The energy dissipation during the bounces occurs classically by at least partially viscous friction in particular at the level of the pivots, and by aerodynamic losses as visible in FIG. 2.

A significant advantage of magnetic or electrostatic field escapement mechanisms is that the tipping point is fixed and perfectly reproducible, and the transmitted energy is constant. In such a configuration the anchor always tips at the same position at the foot of the magnetic barrier when there is one (which is not always the case, and it is also possible to have a combination of a single ramp and a mechanical abutment to play the role of the potential barrier). Therefore, the stopper or anchor always transmits the same amount of energy to the balance, which makes a system of constant force, the excess being dissipated by bounces.

Figure 3:
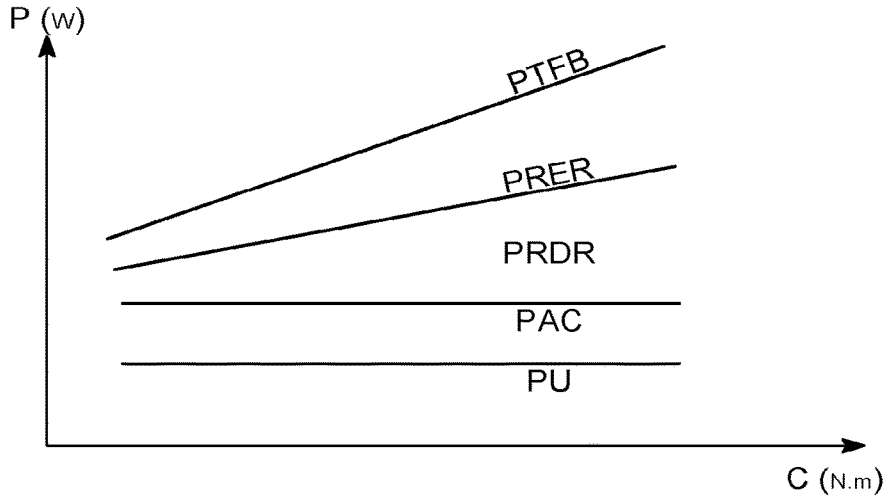
FIG. 3 schematically shows, on the basis of a power scale as ordinate as a function of the driving torque as abscissa, the channels of losses of a magnetic anchor escapement, the triangular zone illustrating the absolute quantity of energy lost by the bounces of the magnet wheel, and showing that at the low torque values corresponding to the letting down of the barrel the operation is only just assured, whereas corresponding to the high torque values supplied by the barrel or the accumulator there is an excess of energy available, which tends to be dissipated by the bounce phenomenon.

Since the barrel does not always supply the same torque, this excess energy dissipated by bounces is not constant, as can be seen in FIG. 3, which shows the different channels of loss of the magnetic anchor escapement, which are from bottom to top:

useful power received by the resonator PU;

anchor losses (shocks) PAC;

losses in the bounces of the wheel (triangular sector) PRDR; these losses can be significant when the barrel is completely wound; the system is dimensioned to function only just at low torque at the end of unwinding of the barrel;

wheel and wheel train rotation losses PRER;

the upper sloping straight line representing the total, i.e. the total power supplied by the barrel PTFB.

The triangular zone represents the absolute quantity of energy lost by the bounces of the magnet wheel.

Figure 4:
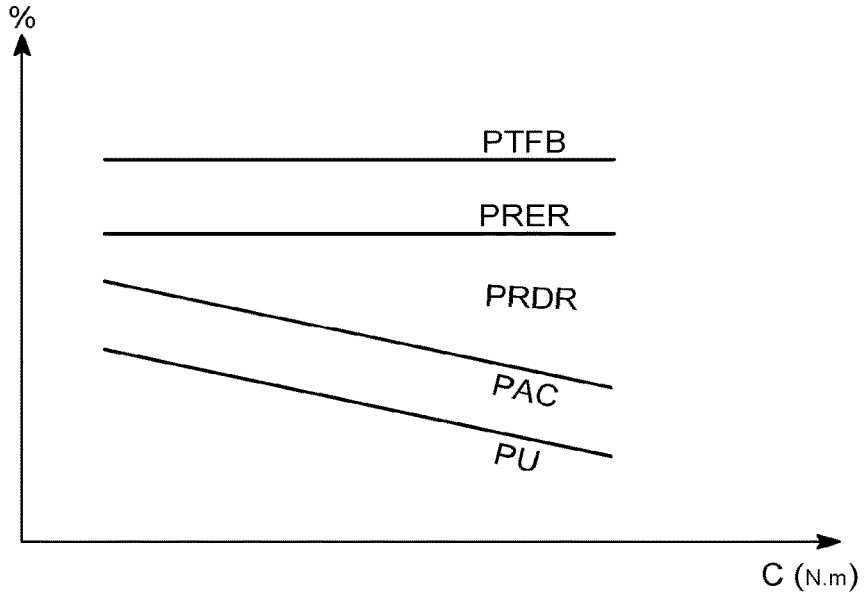
FIG. 4 shows in a similar manner to FIG. 3 the relative losses with the ratio of losses in relation to the total power as ordinate as a function of the drive torque as abscissa, the upper triangular zone illustrating the relative quantity of energy lost by the bounces of the magnet wheel.

FIG. 4 shows, in the same order, the same magnitudes that are represented in relative values in relation to the total power supplied to the escape wheel. This FIG. 4 shows that when the torque of the barrel is high, the proportion of lost energy (not transmitted to the spring balance) in the bounces becomes very significant: almost 50%. Complete suppression of the bounces is not possible.

The invention is compelled to minimise these bounces as far as possible by adding a non-return device such as a pawl or similar acting on the escape wheel.

At the same time, it is a matter of restricting the bounces to a minimum, and above all increasing the efficiency of the escapement mechanism, and consequently the power reserve of the timepiece movement.

Figure 5:
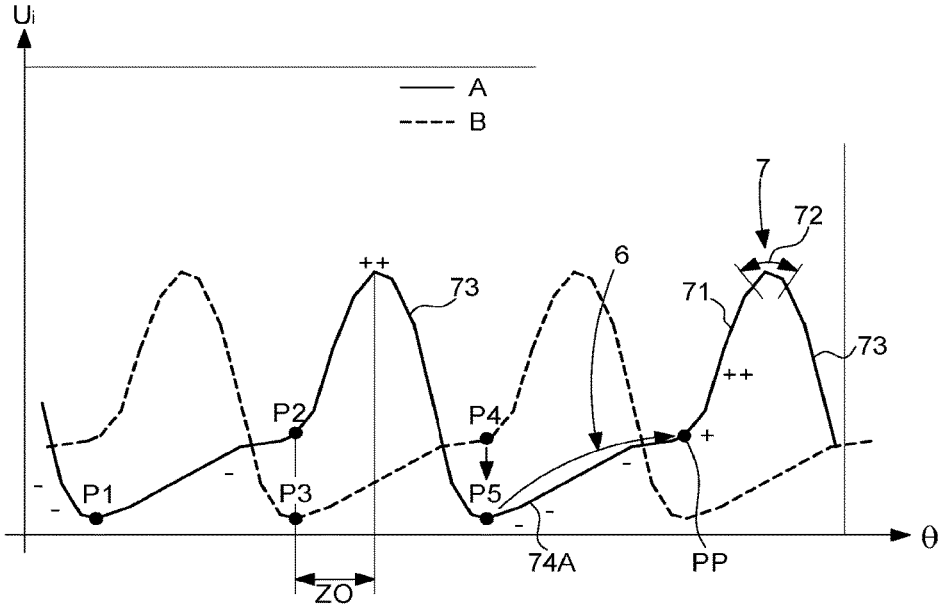
FIG. 5 shows in a similar manner to FIG. 1 the combination according to the invention between the same magnetic escapement and a non-return device shown schematically in a non-restrictive manner by a pawl.

The principle is illustrated in FIG. 5. The tipping point from now on depends on the torque, the transmitted energy is then variable.

The escapement can thus transfer more energy to the spring balance. The efficiency is improved. The system loses its constant force characteristic and becomes an escapement of variable force with the torque, like a traditional Swiss anchor escapement.

Various configurations of the distribution of fields on the track or tracks 4 of the escape wheel 1 are usable.

In a first embodiment illustrated in FIG. 10, the stopper 2 comprises a pole shoe 3 which is a single pole shoe 30 arranged to cooperate successively and alternately with two tracks 4, which are a first track 41 and a second track 42.

In a second embodiment the stopper 2 comprises two pole shoes 3, which are a first pole shoe 31 and a second pole shoe 32, arranged to cooperate successively and alternately with a track 4, which is a single track 40.

The escape wheel 1 comprises, arranged in periodic manner according to a pitch P, a plurality of useful zones ZU, each located between a given zone of minimum potential of such a track 4, 40, 41, 42, on the one hand, and a zone of maximum potential of such a track 4, 40, 41, 42, on the other hand, which zone of maximum potential immediately follows the zone of minimum potential in question of this given track.

Each crossing of such a zone of maximum potential of a track 4, 40, 41, 42 by a pole shoe 3, 30, 31, 32, corresponds to a tipping of the stopper 2.

In the particular configuration comprising ramps 6 and potential barriers 7 at the same time the magnetic or electrostatic field potential ramps 6 arranged on these tracks 4, 40, 41, 42 each comprise a potential barrier 7 at their maximum field potential end that has a tendency to oppose its crossing by a pole shoe 3 of the stopper 2.

More particularly, on such a track 4, 40, 41, 42, each ramp 6 is extended by a magnetic or electrostatic field barrier 7, wherein immediately following the ramp 6 at the level of the particular point PP this barrier 7 has a first zone 71 of rapid potential growth, the gradient of which is higher than the maximum gradient of the ramp 6 concerned. This first zone 71 is followed by a second zone 72 of maximum potential, wherein the concavity of the potential curve is inverted in relation to the first zone 71. The second zone 72 is immediately followed by a third zone 73 of decline in potential where the concavity of the potential curve is inverted in relation to the second zone 72 and this third zone 73 ends at the fourth zone of minimum potential 74.

In the particular configuration of FIG. 10 each useful zone ZU is located between a fourth zone of minimum potential 74 of a said given track 4, 40, 41, 42, on the one hand, and a second zone of maximum potential 72 of such a track 4, 40, 41, 42, immediately following this fourth zone of minimum potential 74 of this given track, on the other. Each crossing of such a second zone of maximum potential 72 of a track 4, 40, 41, 42, by such a pole shoe 3, 30, 31, 32, corresponds to a tipping of the stopper 2.

In an interlinked configuration as in FIG. 10 on a track 4, 40, 41, 42 each said first zone 71 immediately follows the preceding fourth zone 74.

More particularly, on the escape wheel 1 as a whole each first zone 71 immediately follows the preceding fourth zone 74.

Figure 9:
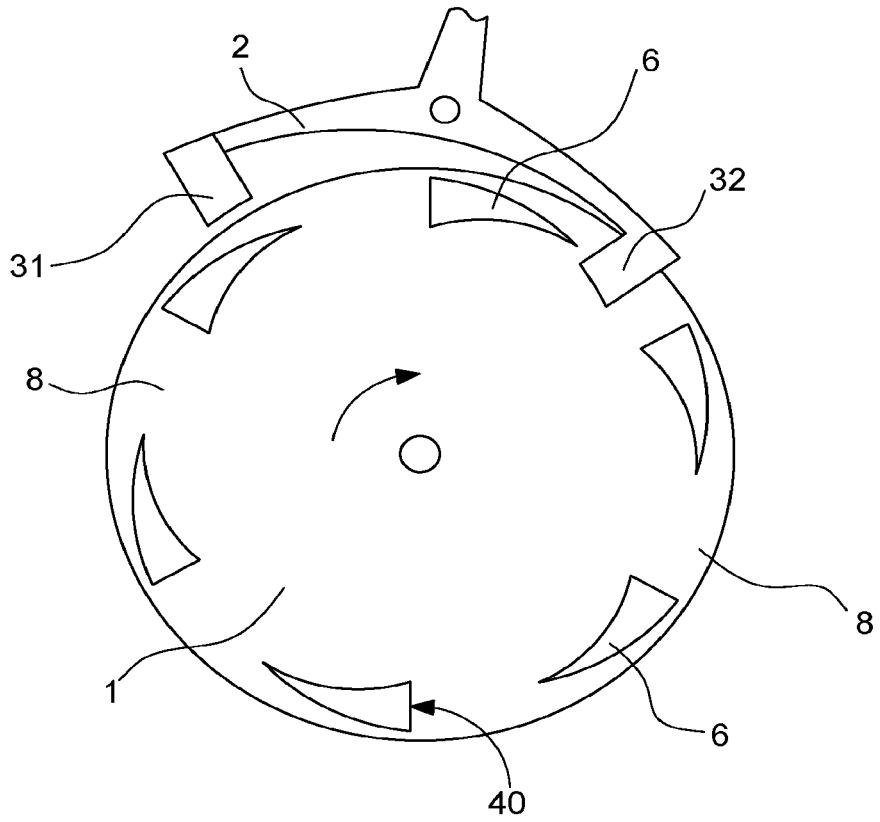
FIG. 9 illustrates in a plan view a simplified escape wheel with alternate ramps devoid of barriers and alternately separated by zones of zero field potential.
Figure 11:
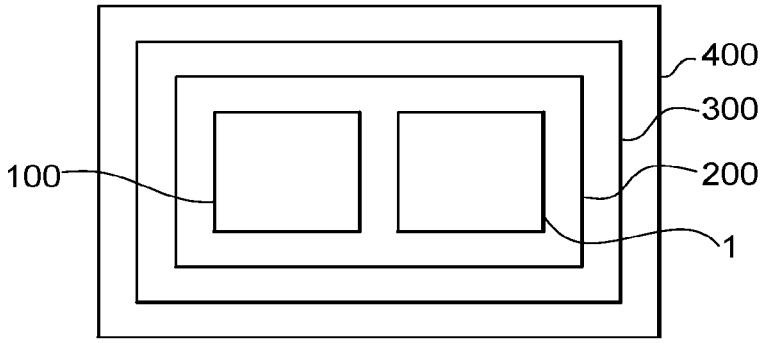
FIG. 11 is a block diagram showing a watch comprising a movement equipped with an escapement mechanism according to the invention.

In a divided configuration as in FIG. 9 on a track 4, 40, 41, 42, each first zone 71 is separated from the preceding fourth zone 74 by a fifth zone 75 of constant or zero potential.

More particularly, on the escape wheel 1 as a whole each first zone 71 is separated from the preceding fourth zone 74 by a fifth zone 75 of constant or zero potential.

In particular variants as in FIG. 9 in particular the magnetic or electrostatic field potential ramps 6 arranged on the tracks 4 are devoid of potential barriers at their maximum field potential end and the tracks 4 each comprise an alternation of zones of zero potential and such ramps 6. Advantageously, in like cases, the magnetic or electrostatic field potential ramps 6 arranged on the tracks 4, 40, 41, 42, are each connected at the level of its maximum potential zone with a mechanical abutment preventing its crossing by a pole shoe 3 of the stopper 2.

In the variants with stopper 2 the non-return device 5 can comprise (non-restrictively) a compression pawl 51, a traction pawl 52, an inside compression pawl 53 or also an inside traction pawl, or combinations of these different pawls, or any other mechanism tending to oppose a recoil of the escape wheel 1.

Figure 6:
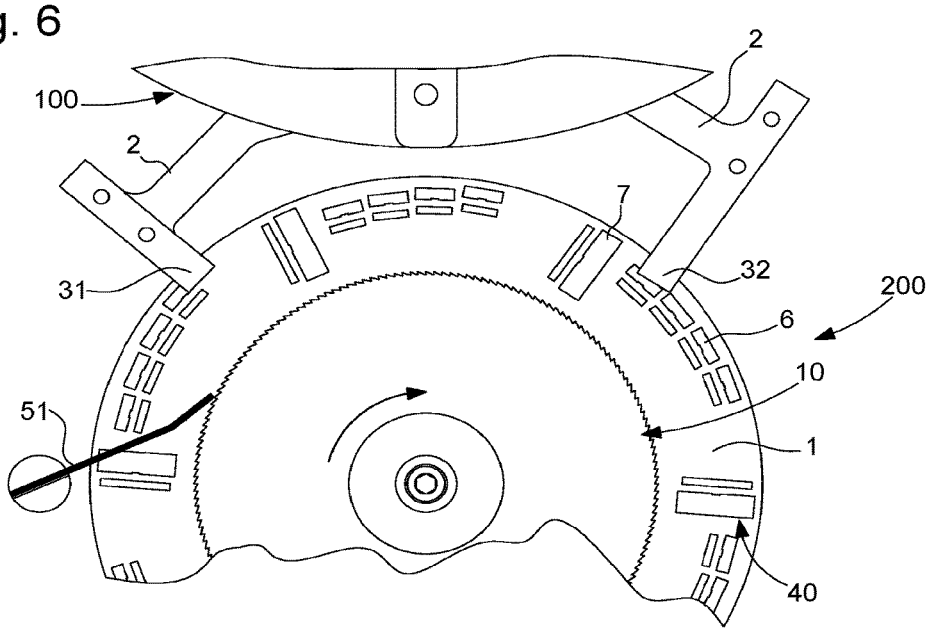
FIG. 6 is a schematic plan view of a magnetic escapement with a stopper comprising two arms, each bearing a pole shoe arranged to cooperate alternately with a track of the escape wheel, which is coupled to a non-return device in the form of a pawl, shown here in a non-restrictive manner in the form of a single pawl.

FIG. 6 shows a compression pawl 51 comprising a first elastic connection with a first fixed part of the escapement mechanism 200 outside the stopper 2 and the escape wheel 1, and this compression pawl 51 cooperates with at least one toothing 10 fixed in pivoting motion to the escape wheel 1. A single pawl 51 is shown so as not to overload the figure, but it is clear, as for the other variants, that the mechanism can comprise a plurality of such pawls, including different types. In the same way, the mechanism can comprise several toothing arrangements, e.g. above and below the median plane of the wheel 1, and possibly in alternating arrangement.

This at least one toothing 10 is preferably a wolf tooth toothing arrangement that permits the advance of the escape wheel 1 by sliding on the compression pawl 51 and opposing the recoil of the escape wheel 1 by subjecting this at least one compression pawl 51 to a buckling force when the escape wheel 1 has a tendency to recoil.

Figure 7:
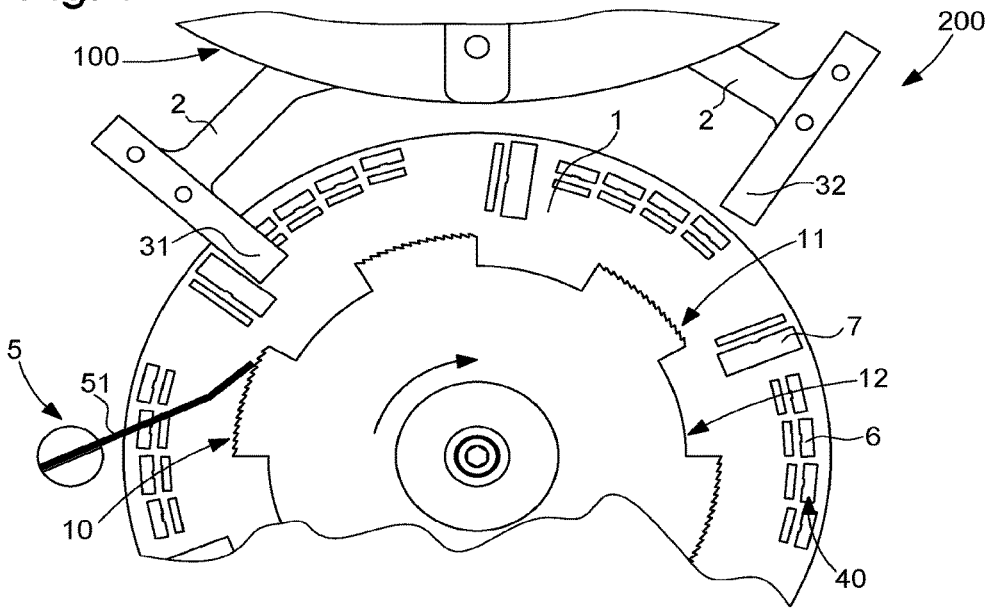
FIG. 7 shows a variant of a mechanism of FIG. 6 where the pawl only cooperates with a toothed sector in certain angular zones where the non-return function is not necessary in order to minimise the losses during the winding of the non-return device, in particular by friction of the pawl in this situation.

In FIG. 7 the non-return device 5 comprises at least one traction pawl 52 comprising a second elastic connection with a second fixed part of the escapement mechanism 200 outside the stopper 2 and the escape wheel 1. This at least one traction pawl 52 cooperates with this at least one toothing 10 and is arranged to operate in traction mode and exert a torque on the escape wheel 1 that tends to cause it to advance when the escape wheel 1 has a tendency to recoil. This traction pawl 52 can be formed either by the preceding compression pawl 51 or by a separate pawl. The toothing 10 is preferably arranged in a similar manner to the previous case.

In another variant the pawl is placed on the escape wheel and the toothing is arranged on a fixed wheel. The non-return device 5 then comprises at least one inside compression pawl 53 comprising a third elastic connection with the escape wheel 1 and cooperating with at least one toothing 10 forming part of a toothed ring fixed on the inside on a fixed part of the escapement mechanism 200 outside the stopper 2 and the escape wheel 1.

Various arrangements are conceivable with respect to the toothing 10.

The variant of FIG. 7 shows that this at least one toothing 10 periodically, alternating with the zones fitted with teeth 11, comprises zones devoid of teeth 12 to minimise the losses when the non-return function is not necessary, when said pole shoe 3 of the stopper 2 cooperates with a zone 8 of zero potential (or zero gradient: of constant potential) of a track 4, 40, 41, 42 or a zone of low potential of a ramp 6.

To assure minimum operation it is necessary that the at least one toothing 10 comprises at least one tooth 13 on each useful zone ZU. This enables the cost of cutting out or cutting the teeth to be reduced. For example, FIG. 10 shows three teeth 13 only for each useful zone ZU.

In a more classic version, this at least one toothing 10 comprises on the zones fitted with teeth forming part of it, at least twenty times more teeth than the escape wheel 1 has pitch P (also so-called equivalent teeth), wherein each pitch P corresponds to the course between two successive tipping movements of the stopper 2. Losses through friction certainly exist, but they are constant and do not impair the chronometric performance.

FIG. 6 illustrates a variant of a non-return device formed by a pawl on the magnetic escape wheel. In an advantageous variant the pawl has a high resolution, which guarantees that the non-return of the wheel is performed correctly. The non-return device preferably comprises at least twenty times more teeth that there are equivalent teeth on the escape wheel. In the non-restrictive example of FIG. 6 there are six equivalent teeth on the wheel and one hundred and eighty at the level of the toothing that cooperates with the pawl.

The winding of the teeth of the pawl consumes a little energy and impairs the efficiency of the escapement. It is possible to minimise this problem by only placing teeth in the operational regions, as illustrated in FIG. 7. The self-starting of the escapement is then also improved on condition that the blade of the pawl is not pre-wound too much.

FIG. 7 thus shows protected zones, to minimise losses, in the work areas where the non-return function is not necessary, i.e. in the zone of lowest (or zero) field potential.

FIGS. 6 and 7 show a first variant where the pawl comprises an elastic blade, which works in compression mode when the wheel has a tendency to recoil.

Figure 8:
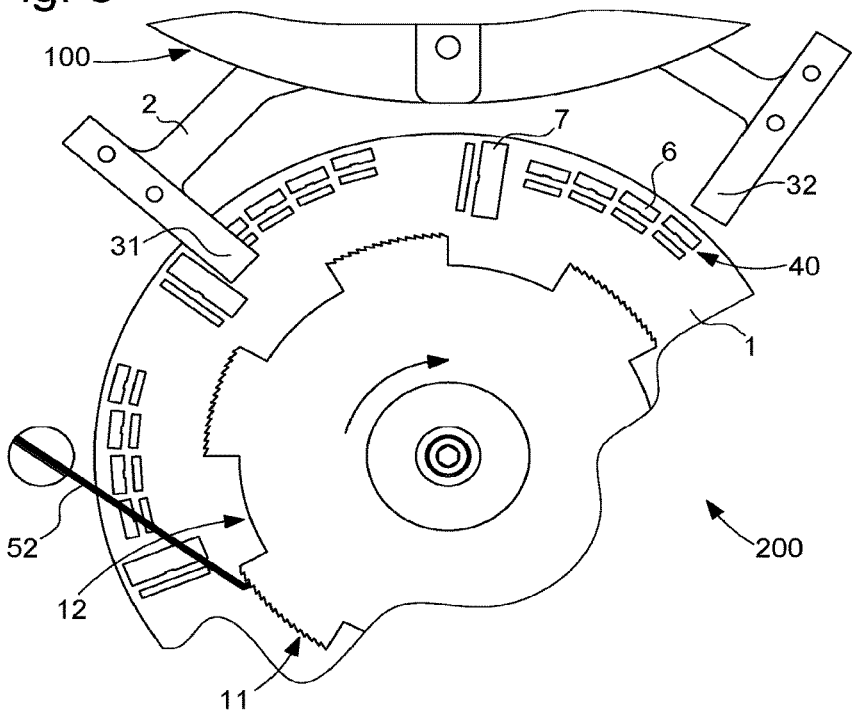
FIG. 8 illustrates a particular work configuration of the mechanism of FIG. 7 where the pawl works in traction mode when the escape wheel has a tendency to pivot in the opposite direction to its normal direction of operation.

A second variant in FIG. 8 relates to a pawl that works in tensile mode when the wheel has a tendency to recoil.

Numerous other non-return devices can be envisaged such as e.g. the systems used in automatic reversers in automatic movements with oscillating winding mass, as described at http://www.horlogerie-suisse.com/technique/les-complications/les-inverseurs-automatiques.

A hard blade can also be used in combination on a soft wheel made of rubber or similar.

In another variant this non-return device 5 comprises at least one free wheel device or a low-hysteresis bearing mechanism such as "OneWay" of "MPS", available at www.mps-watch.com.

The presence of a non-return device provides another advantage that combines with the advantages associated with the operation: the magnetic potential can be lower, and this simplifies the production of magnets and lowers the costs.

Another combination consists of using the original potential, but with a barrel that is dimensioned as tightly as possible, and is therefore much less bulky, which is always sought after in clockmaking, in particular in the case of ladies watches or complicated watches.

Of course, it is also possible to choose to simply increase the power reserve of the movement, all else being equal.

FIG. 9 illustrates another simplified embodiment with magnetic or electrostatic tracks without any field barrier, solely with alternating ramps with zones having a zero potential interposed between the ramps, as illustrated in FIG. 8. The start is again simplified and the usable torque range is again higher.

It is understood that the use of a non-return device does not allow shock-proof mechanical abutments mentioned in document EP 2887157 to be eliminated.

The formation of escapement mechanisms according to the invention is also equally possible with traditional technologies, in particular milling or stamping, or even laser machining enabling a higher resolution to be obtained that is good for machining of the toothing 10.

Moreover, it is possible to minimise the necessary power to cause the non-return device to function using modern production technologies, such as deep silicon etching or LIGA. In particular, the aim is to minimise the inertia, the spring constant or even the coefficient of friction.

The invention also relates to a timepiece movement comprising at least one such escapement mechanism.

The invention also relates to a watch comprising at least one such escapement mechanism.

In short, the non-return device according to the invention enables a substantial increase in efficiency of the escapement mechanism, and therefore of the power reserve of the movement to be obtained at the cost of an inexpensive arrangement with a limited space requirement.

What is claimed is:

1. A timepiece escapement mechanism comprising:

at least one resonator and at least one escape wheel arranged to cooperate with said resonator through a stopper forming part of said escapement mechanism, wherein said escape wheel comprises a succession of tracks carrying magnetic or electrostatic field potential ramps, and said ramps are arranged to cooperate with said resonator or respectively with said stopper; and at least one non-return device arranged to oppose a return of said escape wheel, wherein said stopper cooperates with a plate forming part of said resonator and with the magnetic or electrostatic field potential ramps by at least one pole shoe forming part of said stopper and arranged to move in a field corresponding to said magnetic or electrostatic field potential ramps, and wherein each ramp of the magnetic or electrostatic field potential ramps on a track of said succession of tracks is extended by a magnetic or electrostatic field barrier, wherein, immediately following each ramp, said barrier has a first zone of rapid potential growth, a gradient of which is higher than a maximum gradient of each ramp, wherein said first zone is followed by a second zone of maximum potential, where a concavity of a potential curve is inverted in relation to said first zone, and said second zone is immediately followed by a third zone of decline in potential where the concavity of the potential curve is inverted in relation to said second zone and said third zone ends at a fourth zone of minimum potential.

2. An escapement mechanism according to claim 1, wherein said non-return device comprises at least one compression pawl comprising a first elastic connection with a first fixed part of said escapement mechanism outside said stopper and said escape wheel, and said at least one compression pawl cooperates with at least one toothing fixed in pivoting motion to said escape wheel, and wherein said at least one toothing is a wolf tooth toothing arrangement that permits advance of said escape wheel by sliding on said compression pawl and opposing recoil of said escape wheel by subjecting said at least one compression pawl to a buckling force when said escape wheel has a tendency to recoil.

3. The escapement mechanism according to claim 2, wherein said at least one toothing periodically, alternating with zones fitted with teeth, comprises zones devoid of teeth to minimise losses when a non-return function is not necessary, when said pole shoe of said stopper cooperates with a zone of zero potential of said track or a zone of low potential of each ramp.

4. The escapement mechanism according to claim 2, wherein said at least one toothing comprises at least one tooth on a useful zone.

5. The escapement mechanism according to claim 2, wherein said at least one toothing comprises, on zones fitted with teeth, at least twenty times more teeth than said escape wheel has pitch, wherein each said pitch corresponds to a course between two successive tipping movements of said stopper.

6. The escapement mechanism according to claim 1, wherein said at least one pole shoe of said stopper comprises either a single pole shoe arranged to cooperate successively and alternately with two tracks of said succession of tracks which are a first track and a second track, or two pole shoes, which are a first pole shoe and a second pole shoe arranged to cooperate successively and alternately with one track of said succession of tracks, which is a single track, wherein said escape wheel comprises, arranged in periodic manner according to a pitch, a plurality of useful zones, each located between a given zone of minimum potential of a given track of said succession of tracks and a zone of maximum potential of a track of said succession of tracks immediately following said zone of minimum potential of said given track, and wherein each crossing of said zone of maximum potential of said track by said at least one pole shoe corresponds to a tipping of said stopper.

7. The escapement mechanism according to claim 6, wherein each useful zone is located between a fourth zone of minimum potential of said given track and a second zone of maximum potential of said given track immediately following said fourth zone of minimum potential of said given track, and wherein each crossing of said second zone of maximum potential of said given track by said at least one pole shoe corresponds to a tipping of said stopper.

8. The escapement mechanism according to claim 1, wherein said magnetic or electrostatic field potential ramps arranged on said tracks each comprise a potential barrier at their maximum field potential end that has a tendency to oppose crossing of the potential barrier by said pole shoe of said stopper.

9. The escapement mechanism according to claim 1, wherein on said track each said first zone immediately follows said preceding fourth zone.

10. The escapement mechanism according to claim 1, wherein on said escape wheel each said first zone immediately follows said preceding fourth zone.

11. The escapement mechanism according to claim 1, wherein said non-return device is arranged to minimise bounces of said escape wheel on at least one part of an angular course of said escape wheel.

12. The escapement mechanism according to claim 2, wherein said non-return device comprises at least one traction pawl comprising a second elastic connection with a second fixed part of said escapement mechanism outside said stopper and said escape wheel, wherein said at least one traction pawl cooperates with said at least one toothing and is arranged to operate in traction mode and exert a torque on said escape wheel that tends to cause it to advance when said escape wheel has a tendency to recoil, wherein said traction pawl is formed either by said compression pawl or by a separate pawl.

13. A timepiece movement comprising at least one escapement mechanism according to claim 1.

14. A watch comprising at least one escapement mechanism according to claim 1.

* * * * *